US006689310B1

(12) United States Patent
Cooper

(10) Patent No.: US 6,689,310 B1
(45) Date of Patent: Feb. 10, 2004

(54) MOLTEN METAL DEGASSING DEVICE AND IMPELLERS THEREFOR

(76) Inventor: Paul V. Cooper, 11247 Lake Forest Dr., Chesterland, OH (US) 44026

( * ) Notice: Subject to any disclaimer, the term of this patent is extended or adjusted under 35 U.S.C. 154(b) by 0 days.

(21) Appl. No.: 09/569,461

(22) Filed: May 12, 2000

(51) Int. Cl.[7] ..... C21C 7/00
(52) U.S. Cl. ..... 266/235; 266/217
(58) Field of Search ..... 266/239, 216, 266/233, 235, 217

(56) References Cited

U.S. PATENT DOCUMENTS

| | | | |
|---|---|---|---|
| 209,219 | A | 10/1878 | Bookwalter |
| 251,104 | A | 12/1881 | Finch |
| 364,804 | A | 6/1887 | Cole |
| 506,572 | A | 10/1893 | Wagener |
| 585,188 | A | 6/1897 | Davis |
| 898,499 | A | 5/1908 | O'Donnell |
| 1,100,475 | A | 6/1914 | Franckaerts |
| 1,331,997 | A | 2/1920 | Neal |
| 1,454,967 | A | 5/1923 | Gill |
| 1,518,501 | A | 12/1924 | Gill |
| 1,522,765 | A | 1/1925 | Wilke |
| 1,526,851 | A | 2/1925 | Hall |
| 1,669,668 | A | 5/1928 | Marshall |
| 1,673,594 | A | 6/1928 | Schmidt |
| 1,717,969 | A | 6/1929 | Goodner |
| 1,896,201 | A | 2/1933 | Sterner-Rainer |
| 2,038,221 | A | 4/1936 | Kagi |
| 2,280,979 | A | 4/1942 | Rocke |
| 2,290,961 | A | 7/1942 | Heuer |
| 2,488,447 | A | 11/1949 | Tangen et al. |
| 2,515,478 | A | 7/1950 | Tooley et al. |
| 2,528,210 | A | 10/1950 | Stewart |
| 2,566,892 | A | 9/1951 | Jacobs |
| 2,677,609 | A | 5/1954 | Moore et al. |
| 2,698,583 | A | 1/1955 | House et al. |

(List continued on next page.)

FOREIGN PATENT DOCUMENTS

| | | |
|---|---|---|
| CA | 683469 | 3/1964 |
| CH | 392268 | 9/1965 |
| DE | 1800446 | 12/1969 |
| EP | 0665378 | 8/1995 |
| GB | 942648 | 11/1963 |
| GB | 1185314 | 3/1970 |
| GB | 2217784 | 11/1989 |
| JP | 58-48796 | 3/1983 |
| JP | 63-104773 | 5/1998 |
| NO | 90756 | 1/1958 |
| SU | 416401 | 6/1974 |
| SU | 773312 | 10/1980 |
| WO | 9825031 | 6/1998 |

OTHER PUBLICATIONS

Communication relating to the results of the Partial International search report for PCT/US97/22440 dated May 13, 1998.

Lobanoff et al. Centrifugal Pumps Design & Application *Second Edition*, pp. 173–236. No date.

*Primary Examiner*—Scott Kastler
(74) *Attorney, Agent, or Firm*—Stuart A. Whittington; David E. Rogers; Squire, Sanders & Dempsey LLP

(57) ABSTRACT

A device for dispersing gas into molten metal includes an impeller and a shaft having a first end and a second end. The second end of the shaft is connected to the impeller and the first end is connected to the drive source that rotates the shaft and impeller. The impeller includes a bottom surface, one or more cavities open to the bottom surface, one or more gas-release openings and a connector. The shaft has a gas-transfer passage therein. A gas source is connected to the first end of the shaft. Gas is transferred through the gas-transfer passage and exits through the gas-release opening (s). At least some of the gas enters the cavities where it is mixed with the molten metal being displaced by the impeller. The configuration of the impeller causes the gas and metal to mix efficiently throughout the molten metal bath. Also disclosed are dual-flow and tri-flow impellers that can be used to practice the invention.

39 Claims, 11 Drawing Sheets

U.S. PATENT DOCUMENTS

| | | | |
|---|---|---|---|
| 2,787,873 | A | 4/1957 | Hadley |
| 2,808,782 | A | 10/1957 | Thompson et al. |
| 2,821,472 | A | 1/1958 | Peterson et al. |
| 2,832,292 | A | 4/1958 | Edwards |
| 2,865,618 | A | 12/1958 | Abell |
| 2,901,677 | A | 8/1959 | Chessman et al. |
| 2,948,524 | A | 8/1960 | Sweeney et al. |
| 2,978,885 | A | 4/1961 | Davison |
| 2,984,524 | A | 5/1961 | Franzen |
| 2,987,885 | A | 6/1961 | Hodge |
| 3,010,402 | A | 11/1961 | King |
| 3,048,384 | A | 8/1962 | Sweeney et al. |
| 3,070,393 | A | 12/1962 | Silverberg et al. |
| 3,092,030 | A | 6/1963 | Wunder |
| 3,227,547 | A | 1/1966 | Szekely |
| 3,244,109 | A | 4/1966 | Barske |
| 3,251,676 | A | 5/1966 | Johnson |
| 3,255,702 | A | 6/1966 | Gehrm |
| 3,272,619 | A | 9/1966 | Sweeney et al. |
| 3,289,473 | A | 12/1966 | Louda |
| 3,291,473 | A | 12/1966 | Sweeney et al. |
| 3,400,923 | A | 9/1968 | Howie et al. |
| 3,417,929 | A | 12/1968 | Secrest et al. |
| 3,459,133 | A | 8/1969 | Scheffler |
| 3,459,346 | A | 8/1969 | Tinnes |
| 3,487,805 | A | 1/1970 | Satterthwaite |
| 3,512,762 | A | 5/1970 | Umbricht |
| 3,512,788 | A | 5/1970 | Kilbane |
| 3,575,525 | A | 4/1971 | Fox et al. |
| 3,618,917 | A | 11/1971 | Fredrikson |
| 3,650,730 | A | 3/1972 | Derham et al. |
| 3,689,048 | A | 9/1972 | Foulard et al. |
| 3,715,112 | A | 2/1973 | Carbonnel |
| 3,743,263 | A | 7/1973 | Szekely |
| 3,743,500 | A | 7/1973 | Foulard et al. |
| 3,753,690 | A | 8/1973 | Emley et al. |
| 3,759,635 | A | 9/1973 | Carter et al. |
| 3,767,382 | A | 10/1973 | Bruno et al. |
| 3,776,660 | A | 12/1973 | Anderson et al. |
| 3,785,632 | A | 1/1974 | Kraemer et al. |
| 3,814,400 | A | 6/1974 | Seki |
| 3,824,042 | A | 7/1974 | Barnes et al. |
| 3,836,280 | A | 9/1974 | Koch |
| 3,839,019 | A | 10/1974 | Bruno et al. |
| 3,871,872 | A | 3/1975 | Downing et al. |
| 3,873,305 | A | 3/1975 | Claxton et al. |
| 3,886,992 | A | 6/1975 | Mass et al. |
| 3,915,694 | A | 10/1975 | Ando |
| 3,954,134 | A | 5/1976 | Maas et al. |
| 3,961,778 | A | 6/1976 | Carbonnel et al. |
| 3,972,709 | A | 8/1976 | Chin et al. |
| 3,984,234 | A | 10/1976 | Claxton et al. |
| 3,985,000 | A | 10/1976 | Hartz |
| 3,997,336 | A | 12/1976 | van Linden et al. |
| 4,003,560 | A | 1/1977 | Carbonnel |
| 4,018,598 | A | 4/1977 | Markus |
| 4,052,199 | A | 10/1977 | Mangalick |
| 4,068,965 | A | 1/1978 | Lichti |
| 4,091,970 | A | 5/1978 | Komiyama et al. |
| 4,126,360 | A | 11/1978 | Miller et al. |
| 4,128,415 | A | 12/1978 | van Linden et al. |
| 4,169,584 | A | 10/1979 | Mangalick |
| 4,286,985 | A | 9/1981 | van Linden et al. |
| 4,322,245 | A | 3/1982 | Claxton |
| 4,351,514 | A | 9/1982 | Koch |
| 4,360,314 | A | 11/1982 | Pennell |
| 4,370,096 | A | 1/1983 | Church |
| 4,372,541 | A | 2/1983 | Bocourt et al. |
| 4,392,888 | A | 7/1983 | Eckert et al. |
| 4,410,299 | A | 10/1983 | Shimoyama |
| 4,456,424 | A | 6/1984 | Araoka |
| 4,470,846 | A | 9/1984 | Dube |
| 4,504,392 | A | 3/1985 | Groteke |
| 4,537,624 | A | 8/1985 | Tenhover et al. |
| 4,537,625 | A | 8/1985 | Tenhover et al. |
| 4,556,419 | A | 12/1985 | Otsuka et al. |
| 4,557,766 | A | 12/1985 | Tenhover et al. |
| 4,586,845 | A | 5/1986 | Morris |
| 4,598,899 | A | 7/1986 | Cooper |
| 4,600,222 | A | 7/1986 | Appling |
| 4,609,442 | A | 9/1986 | Tenhover et al. |
| 4,611,790 | A | 9/1986 | Otsuka et al. |
| 4,634,105 | A | 1/1987 | Withers et al. |
| 4,640,666 | A | 2/1987 | Sodergard |
| 4,696,703 | A | 9/1987 | Henderson et al. |
| 4,701,226 | A | 10/1987 | Henderson et al. |
| 4,714,371 | A | 12/1987 | Cuse |
| 4,717,540 | A | 1/1988 | McRae et al. |
| 4,743,428 | A | 5/1988 | McRae et al. |
| 4,770,701 | A | 9/1988 | Henderson et al. |
| 4,786,230 | A | 11/1988 | Thut |
| 4,802,656 | A | 2/1989 | Hudault et al. |
| 4,804,168 | A | 2/1989 | Otsuka et al. |
| 4,810,314 | A | 3/1989 | Henderson et al. |
| 4,834,573 | A | 5/1989 | Asano et al. |
| 4,842,227 | A | 6/1989 | Harrington et al. |
| 4,844,425 | A | 7/1989 | Piras et al. |
| 4,851,296 | A | 7/1989 | Tenhover et al. |
| 4,859,413 | A | 8/1989 | Harris et al. |
| 4,867,638 | A | 9/1989 | Handtmann et al. |
| 4,884,786 | A | 12/1989 | Gillespie |
| 4,923,770 | A | 5/1990 | Grasselli et al. |
| 4,930,986 | A | 6/1990 | Cooper |
| 4,931,091 | A | 6/1990 | Waite et al. |
| 4,940,214 | A | 7/1990 | Gillespie |
| 4,940,384 | A | 7/1990 | Amra et al. |
| 4,954,167 | A | 9/1990 | Cooper |
| 4,973,433 | A | 11/1990 | Gilbert et al. |
| 4,989,736 | A | 2/1991 | Andersson et al. |
| 5,028,211 | A | 7/1991 | Mordue et al. |
| 5,078,572 | A | 1/1992 | Amra et al. |
| 5,088,893 | A | 2/1992 | Gilbert et al. |
| 5,092,821 | A | 3/1992 | Gilbert et al. |
| 5,098,134 | A | 3/1992 | Monckton |
| 5,131,632 | A | 7/1992 | Olson |
| 5,143,357 | A | 9/1992 | Gilbert et al. |
| 5,145,322 | A | 9/1992 | Senior, Jr. et al. |
| 5,152,631 | A | 10/1992 | Bauer |
| 5,162,858 | A | 11/1992 | Shoji et al. |
| 5,165,858 | A | 11/1992 | Gilbert et al. |
| 5,203,681 | A | 4/1993 | Cooper |
| 5,209,641 | A | 5/1993 | Hoglund et al. |
| 5,268,020 | A | 12/1993 | Claxton |
| 5,286,163 | A | 2/1994 | Amra et al. |
| 5,308,045 | A | 5/1994 | Cooper |
| 5,310,412 | A | 5/1994 | Gilbert et al. |
| 5,318,360 | A | 6/1994 | Langer et al. |
| 5,330,328 | A | 7/1994 | Cooper |
| 5,364,078 | A | 11/1994 | Pelton |
| 5,388,633 | A | 2/1995 | Mercer, II et al. |
| 5,399,074 | A | 3/1995 | Nose et al. |
| 5,407,294 | A | 4/1995 | Giannini |
| 5,431,551 | A | 7/1995 | Aquino et al. |
| 5,454,423 | A | 10/1995 | Tsuchida et al. |
| 5,468,280 | A | 11/1995 | Areaux |
| 5,470,201 | A | 11/1995 | Gilbert et al. |
| 5,484,265 | A | 1/1996 | Horvath et al. |
| 5,495,746 | A | 3/1996 | Sigworth |
| 5,509,791 | A | 4/1996 | Turner |
| 5,558,501 | A | 9/1996 | Wang et al. |
| 5,558,505 | A | 9/1996 | Mordue et al. |

5,586,863 A 12/1996 Gilbert et al.
5,597,289 A 1/1997 Thut
5,622,481 A 4/1997 Thut
5,634,770 A 6/1997 Gilbert et al.
5,655,849 A 8/1997 McEwen et al.
5,662,725 A 9/1997 Cooper
5,685,701 A 11/1997 Chandler et al.
5,716,195 A 2/1998 Thut
5,735,668 A 4/1998 Klein
5,735,935 A 4/1998 Areaux
5,741,422 A 4/1998 Eichenmiller et al.
5,772,324 A 6/1998 Falk
5,785,494 A 7/1998 Vild et al.
5,842,832 A 12/1998 Thut
5,944,496 A 8/1999 Cooper
5,947,705 A 9/1999 Mordue et al.
5,951,243 A * 9/1999 Cooper ..... 415/110
5,993,726 A 11/1999 Huang
5,993,728 A 11/1999 Vild
6,036,745 A 3/2000 Gilbert et al.
6,074,455 A 6/2000 van Linden et al.
6,093,000 A * 7/2000 Cooper ..... 417/423.6

* cited by examiner

MOLTEN METAL DEGASSING DEVICE AND IMPELLERS THEREFOR

FIELD OF THE INVENTION

The invention relates to dispersing gas into molten metal. More particularly, the invention relates to a device, such as a rotary degasser, having an impeller that efficiently mixes gas into molten metal and efficiency displaces the molten metal/gas mixture.

BACKGROUND OF THE INVENTION

As used herein, the term "molten metal" means any metal in liquid form, such as aluminum, copper, iron, zinc and alloys thereof, which is amenable to gas purification or that otherwise has gas mixed with it. The term "gas" means any gas or combination of gases, including argon, nitrogen, chlorine, fluorine, freon, and helium, that are mixed with molten metal.

In the course of processing molten metals it is sometimes necessary to treat the molten metal with gas. For example, it is customary to introduce gases such as nitrogen and argon into molten aluminum and molten aluminum alloys in order to remove undesirable constituents such as hydrogen gas and non-metallic inclusions. Chlorine gas is introduced into molten aluminum and molten aluminum alloys to remove alkali metals, such as magnesium. The gases added to the molten metal chemically react with the undesired constituents to convert them to a form (such as a precipitate or a dross) that separates or can be separated from the molten metal. In order to improve efficiency the gas should be dispersed (or mixed) throughout the molten metal as thoroughly as possible. The more thorough the mixing the greater the number of gas molecules contacting the undesirable constituents contained in the molten metal. Efficiency is related to, among other things, (1) the size and quantity of the gas bubbles, and (2) how thoroughly the bubbles are mixed with the molten metal throughout the vessel containing the molten metal.

It is known to introduce gases into molten metal by injection through stationary members such as lances or porous diffusers. Such techniques suffer from the drawback that there is often inadequate dispersion of the gas throughout the molten metal. In order to improve the dispersion of the gas throughout the molten metal, it is known to stir the molten metal while simultaneously introducing gas, or to convey the molten metal past the source of gas injection. Some devices that stir the molten metal while simultaneously introducing gas are called rotary degassers. Examples of rotary degassers are shown in U.S. Pat. No. 4,898,367 entitled "Dispersing Gas Into Molten Metal" and U.S. Pat. No. 5,678,807 entitled "Rotary Degassers," the disclosures of which are incorporated herein by reference.

Devices that convey molten metal past a gas source while simultaneously injecting gas into the molten metal include pumps having a gas-injection, or gas-release, device. Such a pump generates a molten metal stream through a confined space such as a pump discharge or a metal-transfer conduit connected to the discharge. Gas is then released into the molten metal stream while (1) the stream is in the confined space, or (2) as the stream leaves the confined space.

There are several problems associated with the prior art devices that make them relatively inefficient. Inefficient in this sense means that the known devices do not efficiently disperse gas into the molten metal bath. Therefore, the impurities in the molten metal are not adequately removed and/or an inordinate amount of gas is used to remove the impurities. The inefficiency of the prior art devices is a function of, among other things, their (1) inability to create small gas bubbles to mix with the molten metal, and (2) displace the gas bubbles and/or the molten metal/gas mixture throughout the vessel containing the molten metal. With the prior art devices (other than certain of the previously-described pumps), gas released into the bath tends to rise vertically through the bath to the surface, and the gas has little or no interaction with the molten metal in the vessel relatively distant from the gas-release device. The molten metal/gas mixture is not sufficiently displaced throughout the entire bath. Therefore, to the extent gas is mixed with the molten metal, it is generally mixed only with the molten metal immediately surrounding the prior art device.

It is also known to inject degassing flux through an opening into the molten metal, which again, results in the flux mixing with only the molten metal near where it is released.

SUMMARY OF THE INVENTION

The present invention provides an improved device and method for dispersing gas within molten metal. The invention is used in a vessel containing a molten metal bath, and the invention preferably includes (1) a shaft (sometimes referred to herein as an impeller shaft) having a first end, a second end and a passage for transferring gas, (2) an impeller (also referred to as a rotor) having a connector, a top surface, a lower surface, a gas-release opening, and a plurality of cavities open to the lower surface, and (3) a drive source for rotating the shaft and the impeller. The first end of the shaft is connected to the drive source and the second end is connected to the connector of the impeller. The impeller is designed to displace a large volume of molten metal thereby efficiently circulating the molten metal within the vessel. The impeller is preferably rectangular (and most preferably square) in plan view, has four sides, a top surface and a lower surface, and includes a plurality of cavities open to the lower surface of the impeller. Preferably, there are four cavities, one being centered on each side of the impeller. The connector is preferably located in the top surface of the impeller and connects the impeller to the second end of the shaft. Most preferably the connector is a threaded bore extending from the top surface to the lower surface of the impeller thereby forming an opening in the top surface and the lower surface. The upper portion of the bore threadingly receives the second end of the shaft. The gas-release opening may be the opening in the lower surface of the impeller formed by the bore. The passage in the shaft preferably terminates at the second end at an opening. The second-end of the shaft, and the preferred embodiment of the opening therein, may be flush with or extend beyond the opening in the lower surface of the impeller. The gas-release opening may be the opening in the second end of the shaft, which is preferred.

The drive source rotates the shaft and the impeller. A gas source is preferably connected to the first end of the shaft and gas is released into the passage. The gas passes through the passage and is released through the gas-release opening (s). At least part of the gas enters the cavities where it is mixed with the molten metal entering the cavities. The molten metal/gas mixture is displaced radially by the impeller as it rotates.

Optionally, the invention can utilize a dual-flow (or mixed-flow) impeller. Dual-flow means that the impeller both directs molten metal downward into the molten metal bath and outward away from the impeller. The dual-flow impeller-of the present invention preferably has a plurality of vanes wherein each vane preferably comprises: (1) a first surface to direct molten metal downward into the molten metal bath, and (2) a second surface to direct molten metal outward from the impeller. The first surface is preferably positioned on a horizontally-oriented projection that includes a leading edge, an upper surface and a lower surface. The first surface is preferably-an angled wall formed in the lower surface of the horizontally-oriented projection near the leading edge. The second surface is preferably a vertical face beneath the horizontally-oriented projection that directs the molten metal outward from the impeller. Each vane includes a trailing side (opposite the first surface and second surface) that preferably includes a recess that improves the efficiency of the rotor by allowing more molten metal to enter the pump chamber.

Further, the invention may include a tri-flow rotor that (1) directs molten metal downward into the molten metal bath, (2) directs molten metal upward from the lower of the molten metal bath, and (3) directs molten metal outward from the impeller.

Another aspect of the present invention are impellers that can be used with a degassing device according to the invention.

DESCRIPTION OF A PREFERRED EMBODIMENT

Figure 1:
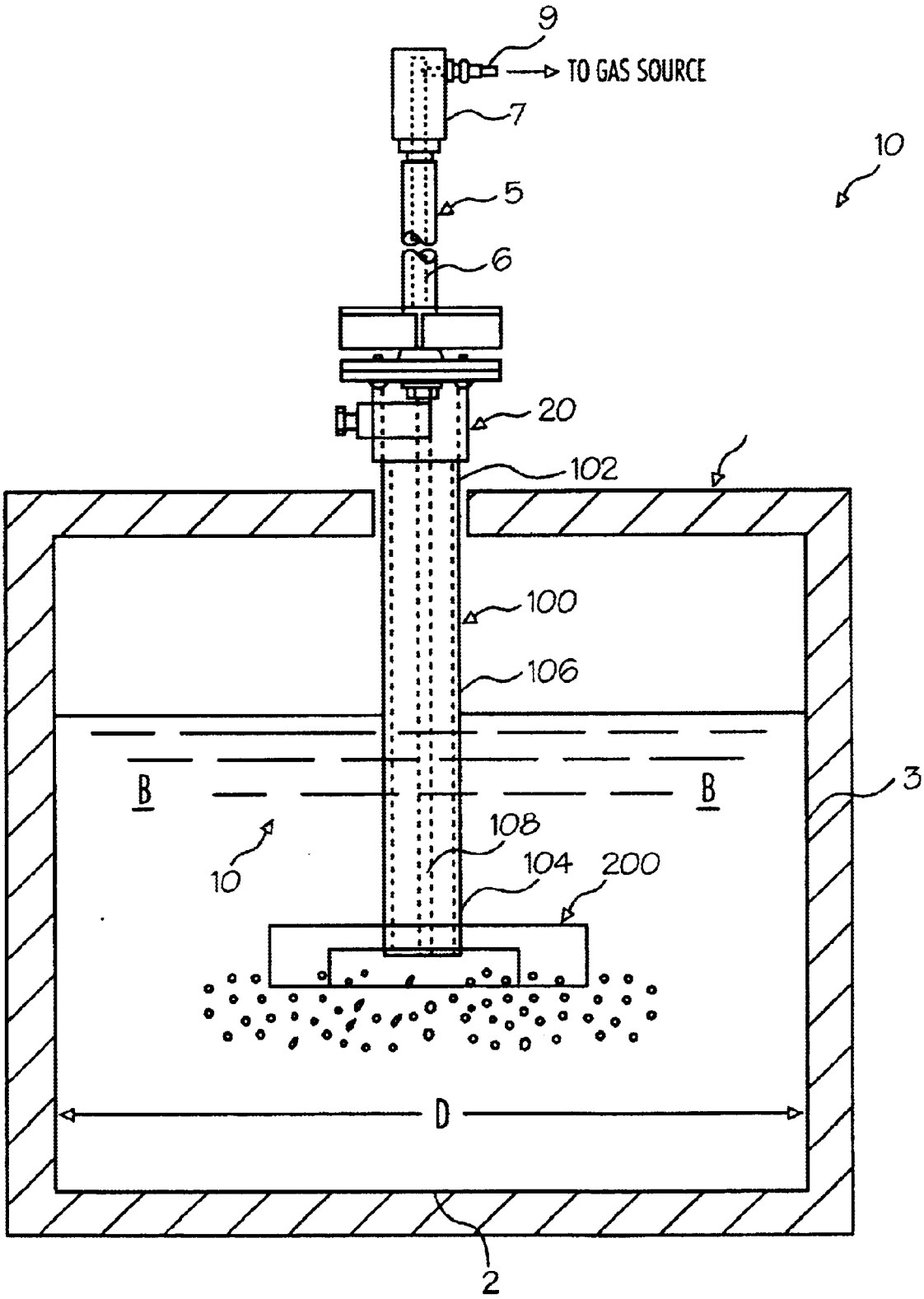
FIG. 1 is a front view of a gas-release device according to the invention positioned in a vessel containing a molten metal bath.

Referring now to the drawings where the purpose is to describe a preferred embodiment of the invention and not to limit same, FIG. 1 shows a gas-release device 10 according to the invention. Device 10 is adapted to operate in a molten metal bath B contained within a vessel 1. Vessel 1 is provided with a lower 2 and side wall 3. Vessel 1 can be provided in a variety of configurations, such as rectangular or cylindrical. For purposes of the present description, vessel 1 will be described as cylindrical, having cylindrical side wall 3, with an inner diameter D, as shown in FIG. 1.

Device 10, which is preferably a rotary degasser, includes a shaft 100, an impeller 200 and a drive source (not shown). Device 10 preferably also includes a drive shaft 5 and a coupling 20. Shaft 100, impeller 200, and each of the impellers used in the practice of the invention, are preferably made of graphite impregnated with oxidation-resistant solution, although any material capable of being used in a molten metal bath, such as ceramic, could be used. Oxidation and erosion treatments for graphite parts are practiced commercially, and graphite so treated can be obtained from sources known to those skilled in the art.

The drive source can be any apparatus capable of rotating shaft 100 and impeller 200 and is preferably a pneumatic motor or electric motor, the respective structures of which are known to those skilled in the art. The drive source can be connected to shaft 100 by any suitable means, but is preferably connected by drive shaft 5 and coupling 20. Drive shaft 5 is preferably comprised of steel, has an inner passage 6 for the transfer of gas, and preferably extends from the drive source to which it is connected by means of a rotary union 7. Drive shaft 5 is coupled to impeller shaft 100 by coupling 20. The preferred coupling 20 for use in the invention is described in U.S. Pat. No. 5,678,807, the disclosure of which is incorporated herein by reference.

Figure 2:
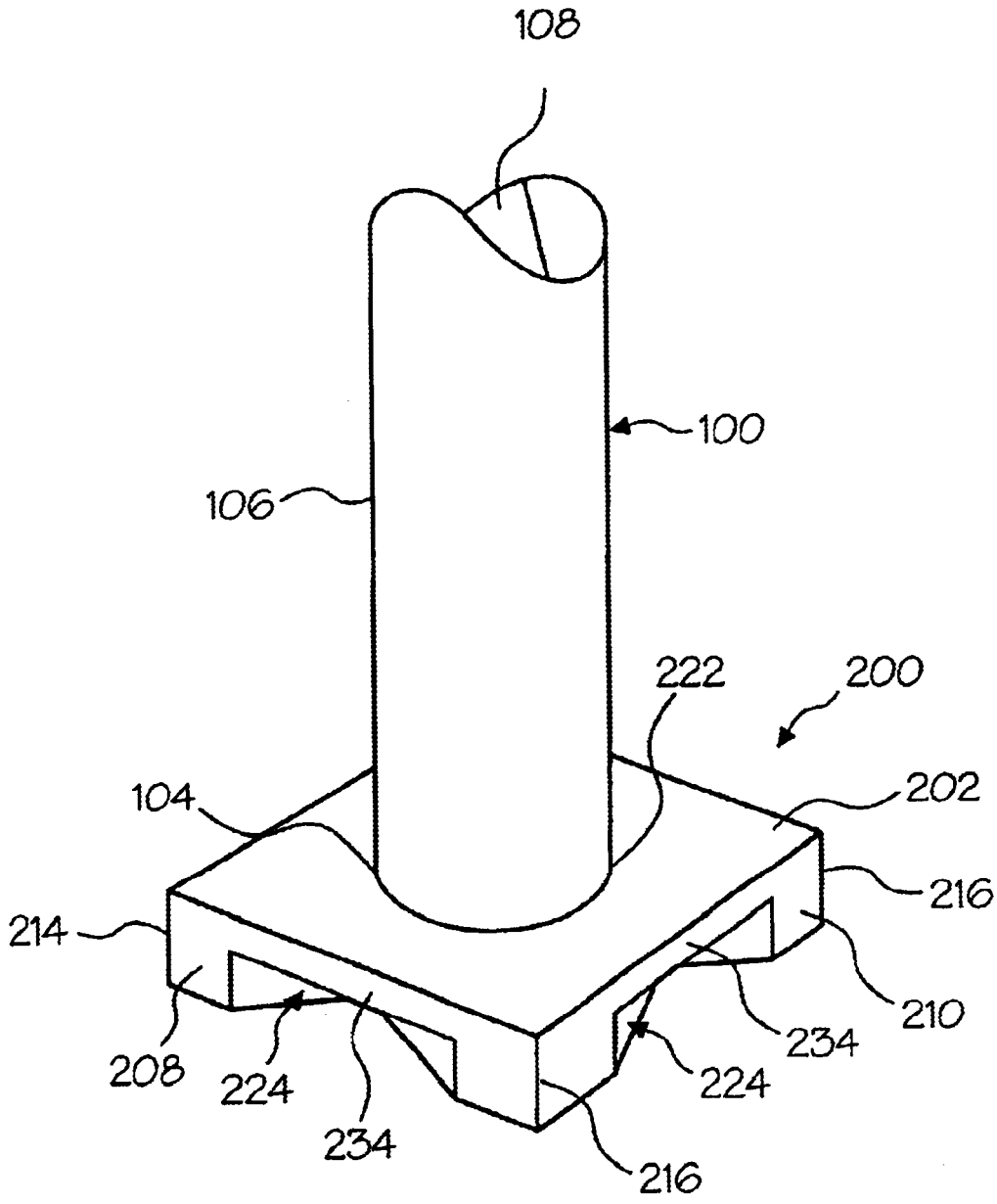
FIG. 2 is a partial perspective view of the device of FIG. 1 showing the degasser shaft and impeller.

As is illustrated in FIGS. 1 and 2, shaft 100 has a first end 102, a second end 104, a side 106 and an inner passage 108 for transferring gas. Shaft 100 may be a unitary structure or may be a plurality of pieces connected together. The purpose of shaft 100 is to connect to an impeller to (1) rotate the impeller, and (2) transfer gas. Any structure capable of performing these functions can be used.

Figure 4:
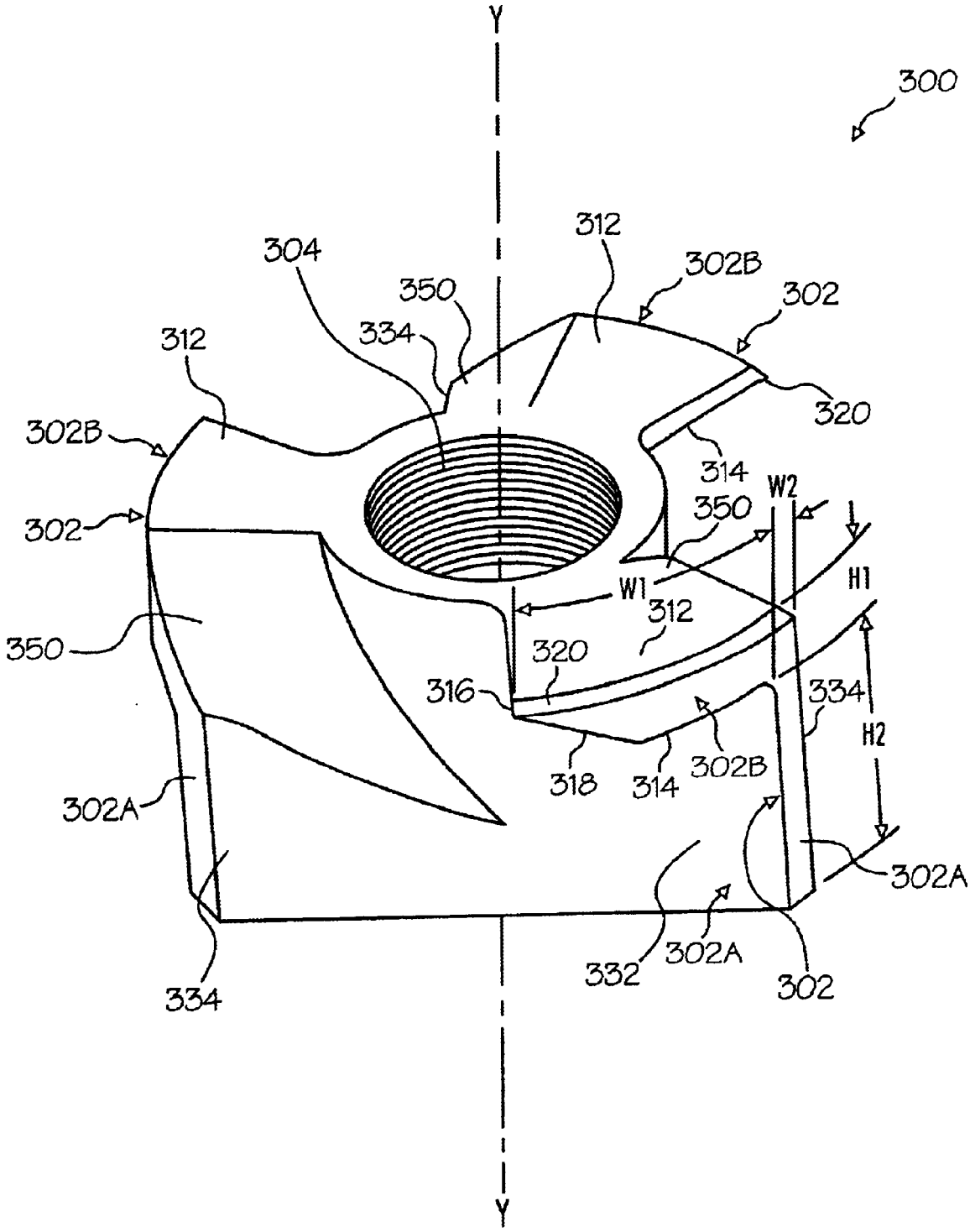
FIG. 4 is a perspective view of an alternative impeller according to the invention.

First end 102 is connected to the drive source, preferably by shaft 5 and coupling 20, as previously mentioned. In this regard, first end 102 is preferably connected to coupling 20, which in turn is connected to motor drive shaft 5. Shaft 5 is connected to rotary union 7. A typical rotary union 7 is a rotary union of the type described in pending U.S. patent application Ser. No. 09/152,168 to Cooper, filed Sep. 11, 1998, the disclosure of which from page 9, line 21 to page 10, line 23, and FIGS. 4 and 4D, are incorporated herein by reference. Side 106 is preferably cylindrical and may be threaded, tapered, or both, at end 102. In the embodiment shown, end 102 (which is received in coupling 20) is smooth and is not tapered. Side 106 is preferably threaded at end 104 for connecting to impeller 200. Passage 108 is connected to a gas source (not shown), preferably by connecting the gas source to nozzle 9 of rotary union 7, and transferring gas through a passage in rotary union 7, through inner passage 6 in shaft 5 and into passage 108.

Figure 3:
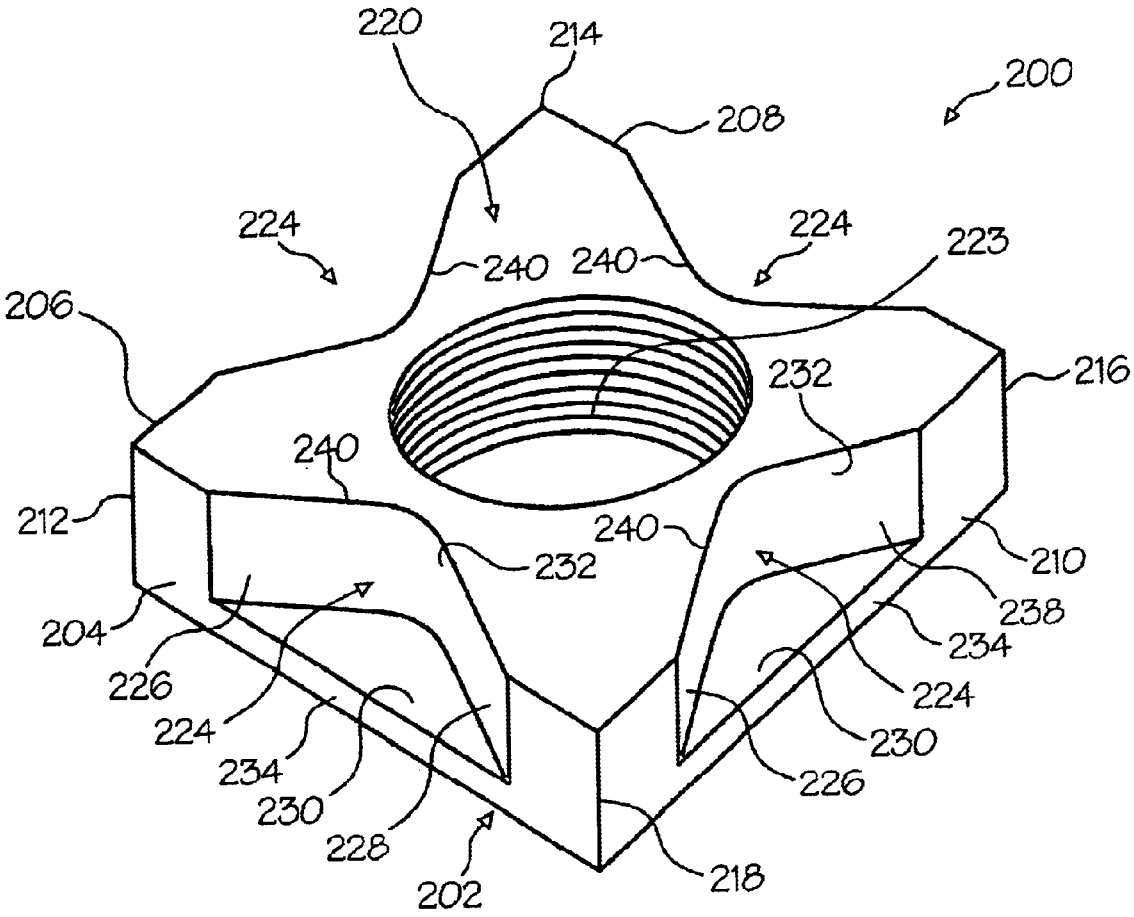
FIG. 3 is a lower, perspective view of the impeller shown in FIGS. 1–2.

Turning now to FIGS. 2 and 3, an impeller 200 is shown. Impeller 200 is designed to displace a relatively large quantity of molten metal as compared to known impellers in order to improve the efficiency of mixing the gas and molten metal within bath B. Therefore, impeller 200 can, at a slower speed (ie., lower revolutions per minute (rpm)), mix the same amount of gas with molten metal as prior art devices operating at higher speeds. Impeller 200 can preferably also operate at a higher speed at which it would mix more gas and molten metal than prior art devices operating at the same speed.

By operating impeller 200 at a lower speed less stress is transmitted to the moving components, which leads to longer component life, less maintenance and less maintenance downtime. Another advantage that may be realized by operating the impeller at slower speeds is the elimination of a vortex. Some prior art devices must be operated at high speeds to achieve a desired efficiency. This can create a vortex that draws air into the molten metal from the surface of bath B. The air can become trapped in the molten metal and lead to metal ingots and finished parts that have air pockets, which is undesirable.

Impeller 200 has a top surface 202, four sides 204, 206, 208 and 210, four corners 212, 214; 216 and 218, and a lower surface 220. Impeller 200 is preferably imperforate, rectangular, and most preferably square in plan view, with sides 204, 206, 208 and 210 being preferably equal in length. It also is possible that impeller 200 could be triangular, pentagonal, or otherwise polygonal in plan view. A connector 222 is formed in top surface 202. Connector 222 is preferably a threaded bore that extends from top surface 202 to lower surface 220 and terminates in gas-release opening 223.

Figure 3A:
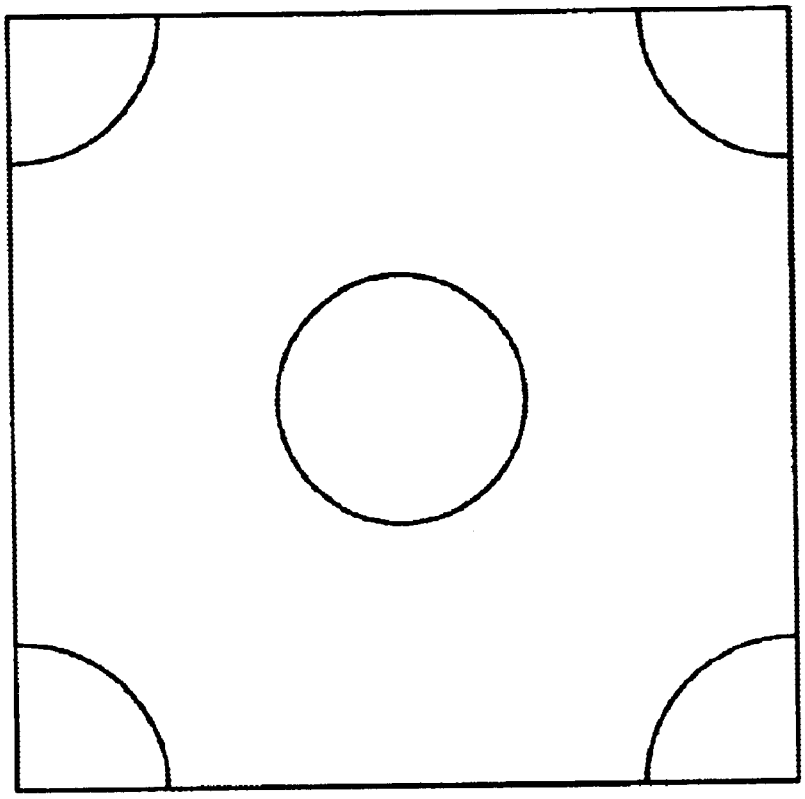
FIG. 3A is a top view of an alternative impeller according to the invention.
Figure 8:
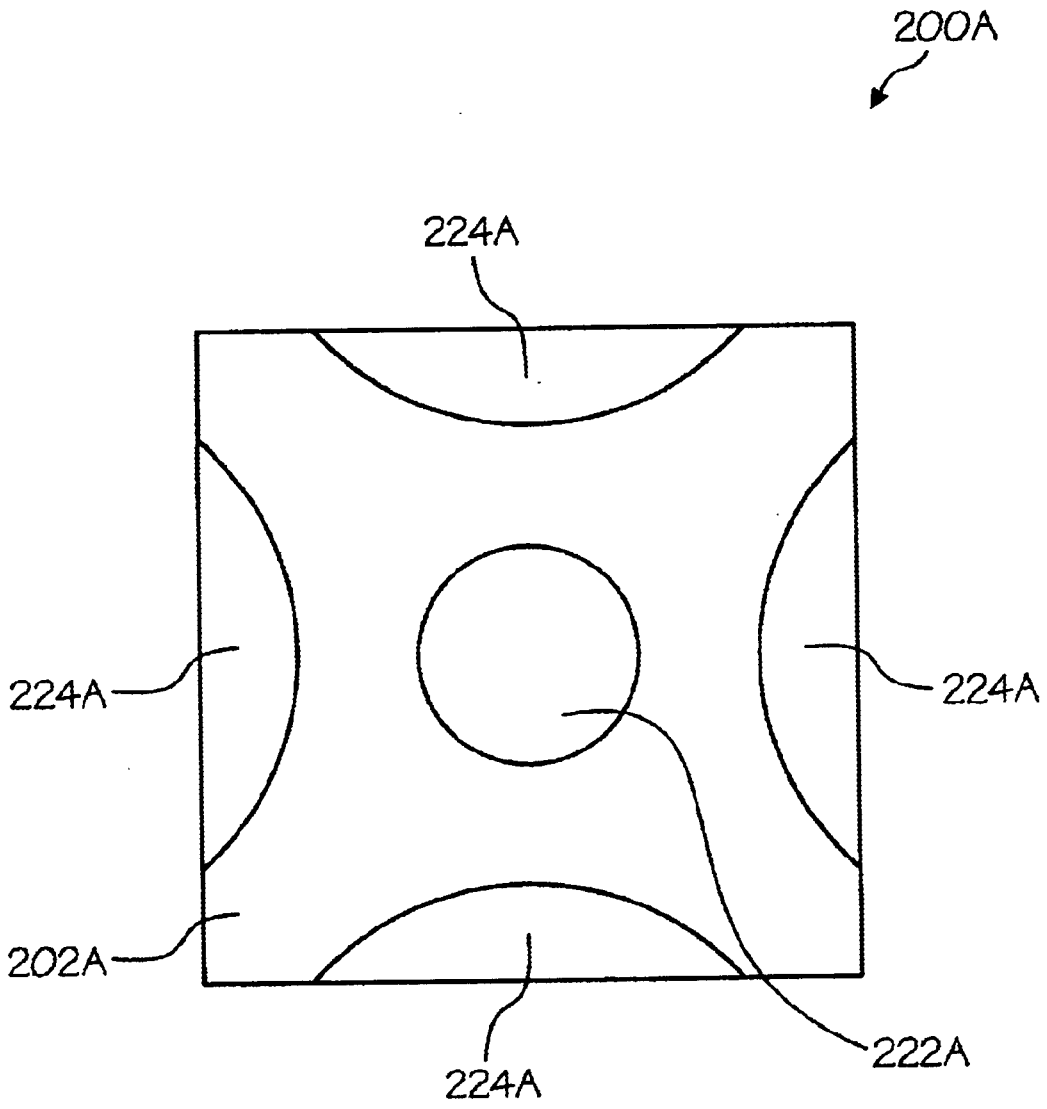
FIG. 8 is a top view of an alternate impeller according to the invention.

A cavity 224 is preferably formed juxtaposed each of sides 204, 206, 208 and 210. Each cavity 224 is preferably formed in the center of the side with which it is juxtaposed (although one or more of the cavities could be formed off center). Each cavity preferably has an identical structure. Therefore, only one cavity 224 shall be described. The cavities need not, however, be identical in structure or dimension, as long as some of the gas escaping through the gas-release opening enters each cavity where it is mixed with the molten metal entering the cavity. Further, the invention could function with fewer than or more than four cavities 224. Additionally, the cavities may be formed in each of the corners of impeller 200, rather than being juxtaposed a side as shown in FIG. 3A. Furthermore, impeller 200 may have more than one cavity juxtaposed a single side. Additionally, the length of each cavity may be greater or smaller than shown and one or more cavities may be as long as the side on which it is formed. Furthermore, as shown in FIG. 8, an impeller 200A may have one or more cavities 224A formed in upper surface 202A of impeller 200A, in which case the lower surface of the impeller may or may not include cavities. Impeller 200A would likely be used conjunction with a device that directed molten metal downward towards the cavities in upper surface 202A. Such a device could be an additional vane on impeller 200A above upper surface 202A, wherein the additional vane directed molten metal downward towards the one or more cavities 224A. Cavities 224A in upper surface 202A may be the same shape, and may be in the same number and in the same relative locations as explained herein with respect to the cavities in lower surface 220.

Figure 8A:
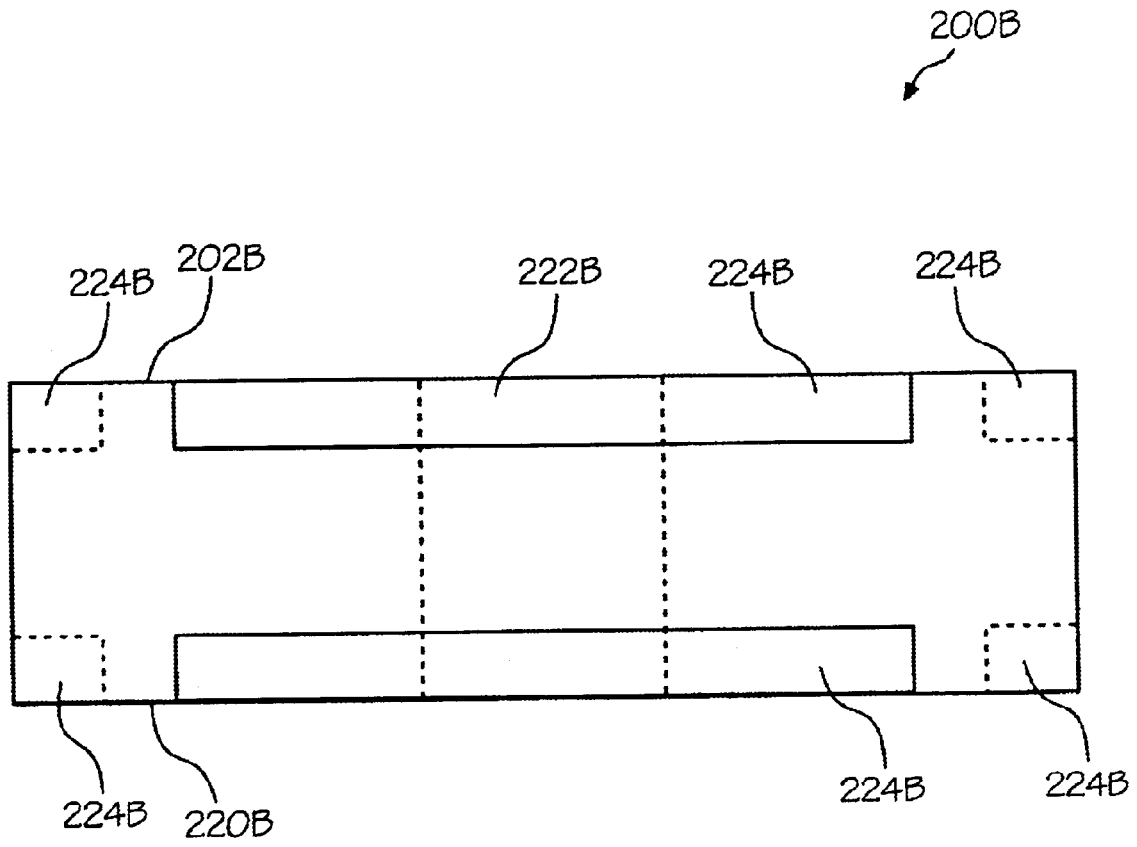
FIG. 8A is a side view of an alternative impeller according to the invention.

FIG. 8A is a side view of an impeller 200B according to the invention. Impeller 200B has an upper surface 202B, a lower surface 220B, a connector, 222B, which is preferably a threaded bore, one or more cavities 224B formed in the lower surface 200B and one or more cavities 224B formed in upper surface 202B. If an impeller according to the invention has cavities in the upper surface and lower surface, the cavities in the upper surface need not be the same shape, the same number or in the same relative location as any cavities in the lower surface.

In addition, any of the impellers described herein may be used with a device or devices formed or placed above and/or below the impeller. Such device or devices could either direct molten metal upward from the bottom of the bath or downward from the top of the bath. Such device(s) may be attached to the shaft and/or attached to the impeller. For example, any of the impellers described herein may have an additional vane or projection beneath the lower surface to direct molten metal upward, or an additional vane or projection above the upper surface to direct molten metal downward. Unless specifically disclaimed, all such embodiments are intended to be covered by the claims.

Cavity 224 is open to lower wall 220. It has two angular sides 226 and 228 that are preferably formed at approximately 30° angles and a top wall 230. A radiused center 232 connects sides 226, 228. A lip 234 is formed between top wall 230 and top surface 202; lip 234 preferably has a minimum width of ¼". Lower surface 220 has edges 240 juxtaposed each of the recesses 224. Further, any of the cavities could be formed with a single radiused wall, as shown in FIG. 8.

Figure 9:
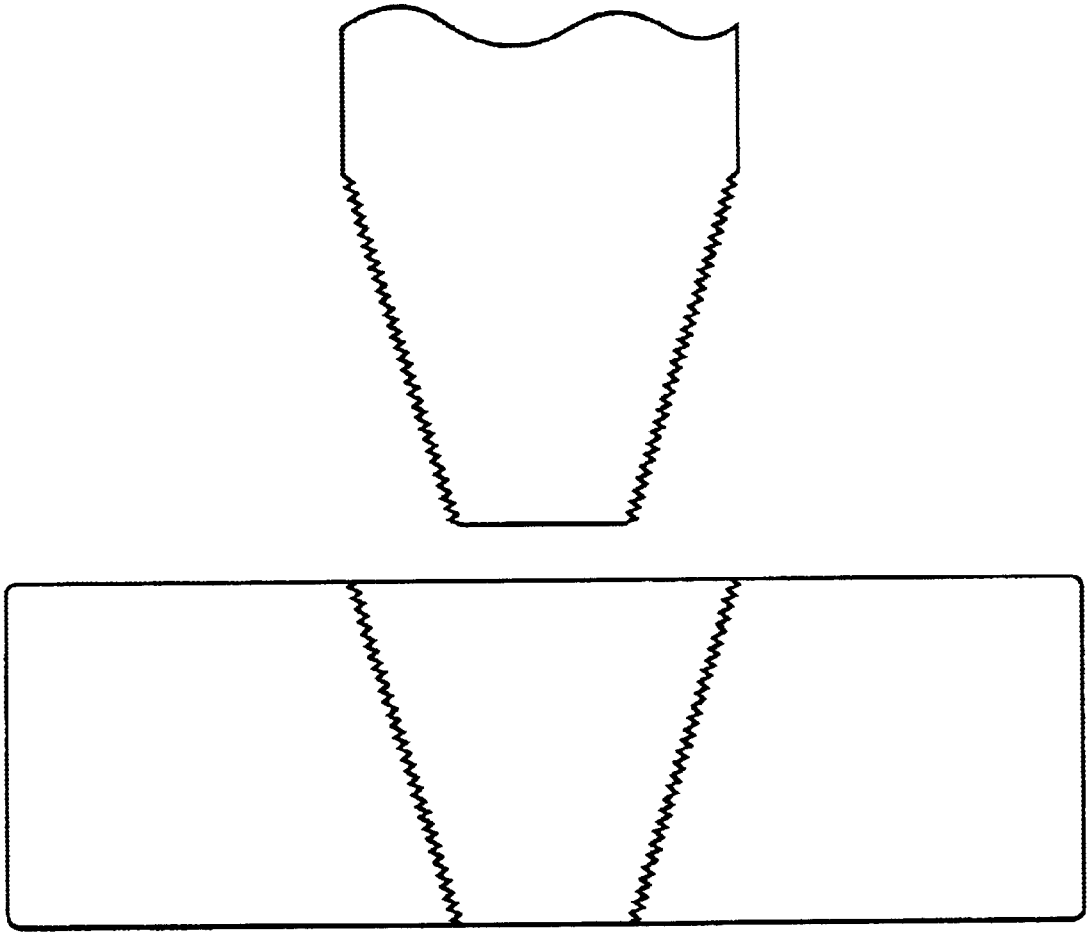
FIG. 9 shows an embodiment of the invention in which the second end of the shaft is tapered and is threadingly received in a tapered bore in the impeller.

Second end 104 of shaft 100 is preferably connected to impeller 200 by threading end 104 into connector 222. If desired, shaft 100 could be connected to impeller 200 by techniques other than a threaded connection, such as by being cemented or pinned. A threaded connection is preferred due to its strength and ease of manufacture. The use of coarse threads (4 pitch, UNC) facilitates manufacture and assembly. The threads may be tapered, as shown in FIG. 9.

Upon placing impeller 200 in molten metal bath B and releasing gas through passage 108, the gas will be released through gas-release opening 223 in the form of bubbles that flow outwardly along lower surface 220. Alternatively, there may one or more gas-release openings in each of cavities 224, in which case opening 223 would be sealed. Further, end 104 could extend beyond lower surface 220 in which case the opening in end 104 would be the gas-release opening.

As shaft 100 and impeller 200 rotate the gas bubbles will rise and at least some of the gas enters cavities 224. The released bubbles will be sheared into smaller bubbles as they move past a respective edge 240 of lower surface 220 before they enter a cavity 224. As rotor 200 turns, the gas in each of cavities 224 mixes with the molten metal entering the cavity and this mixture is pushed outward from impeller 200. The molten metal/gas mixture is thus efficiently displaced within vessel 1. When the molten metal is aluminum and the treating gas is nitrogen or argon, shaft 100 and impeller 200 preferably rotate within the range of 200–400 revolutions per minute.

By using the apparatus according to the invention, high volumes of gas can be thoroughly mixed with the molten metal at relatively low impeller speeds. Unlike some prior art devices that do not have cavities, the gas cannot simply rise past the side of the impeller. Instead at least some of the gas enters the cavities 224 and is mixed with the molten metal. This is another reason impeller 200 can operate at slower speeds. Some impellers operate at high speeds in an effort to mix the gas quickly before it rises past the side of the impeller. Device 10 can pump a gas/molten metal mixture at nominal displacement rates of 1 to 2 cubic feet per minute (cfm), and flow rates as high as 4 to 5 cfm can be attained.

Figure 5:
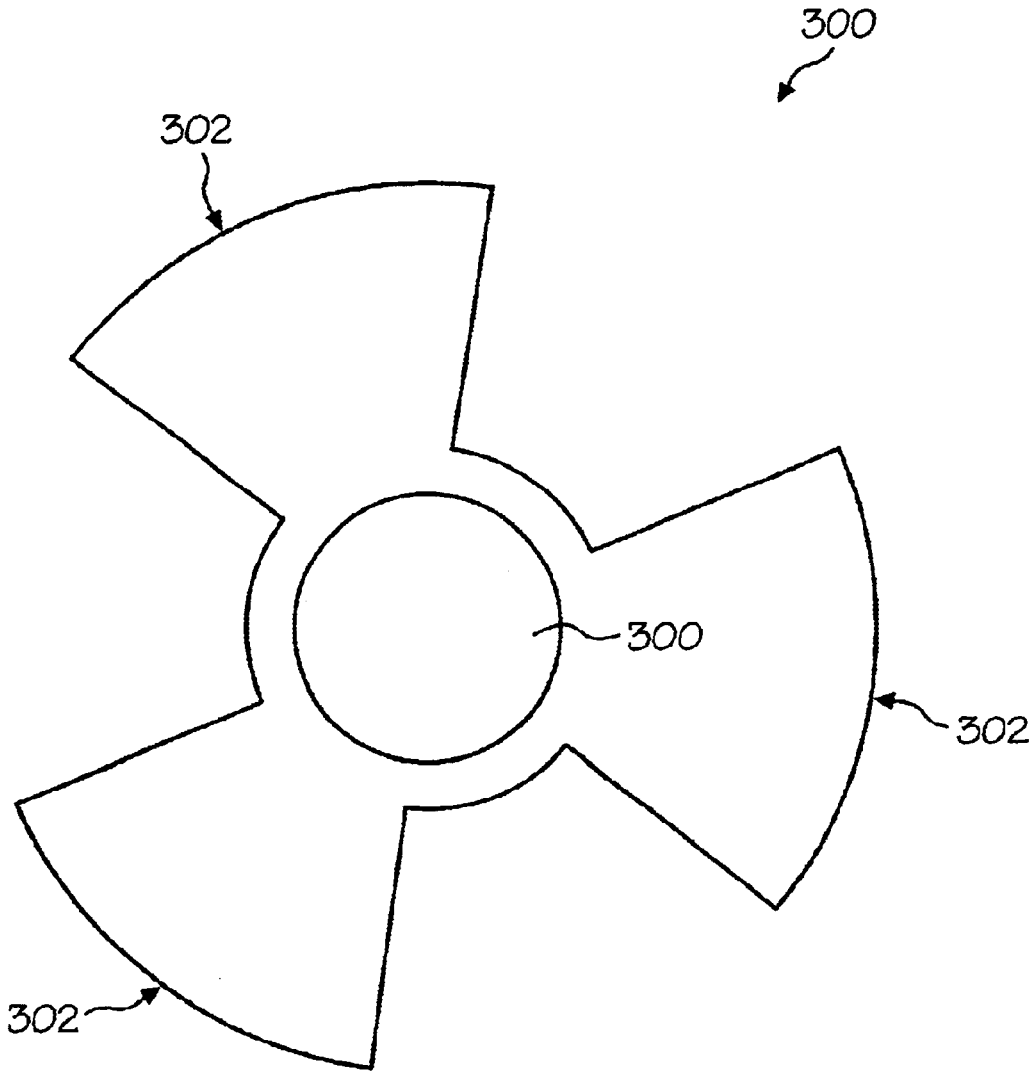
FIG. 5 is a top view of the impeller shown in FIG. 4.
Figure 6:
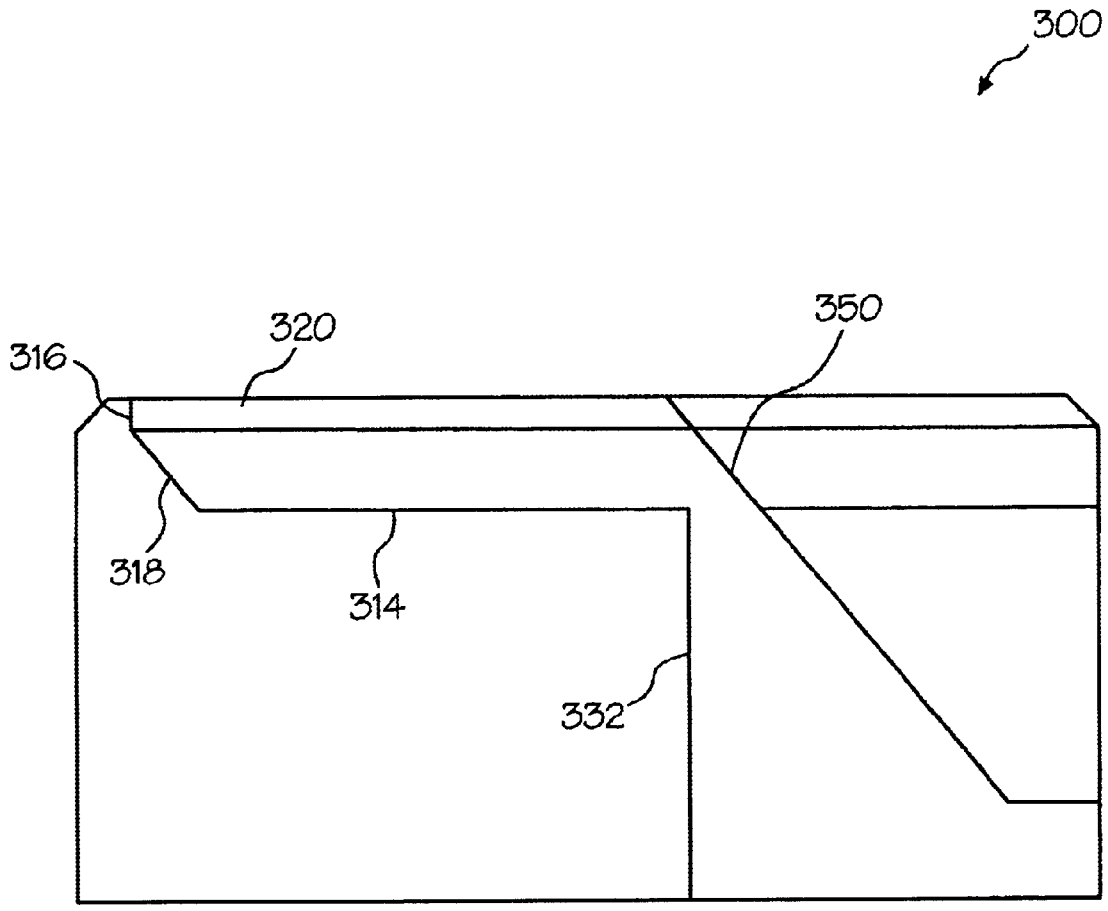
FIG. 6 is a side view of the impeller shown in FIG. 4.

An alternate, dual-flow impeller 300 is shown in FIGS. 4–6. Impeller 300 is preferably imperforate, formed of graphite and connected to and driven by shaft 100. Impeller 300 preferably has three vanes 302. Impeller 300 further includes a connective portion 304, which is preferably a threaded bore, but can be any structure capable of drivingly engaging shaft 100.

Impeller 300 rotates about an axis Y. Preferably, each vane 302 includes a vertically-oriented portion 302A and a horizontally-extending projection 302B. Preferably each vane 302 has the same configuration so only one vane 302 shall be described. The purpose of portion 302A is to direct molten metal outward away from impeller 300. The purpose of projection 302B is to direct molten metal downward towards lower surface 2 of vessel 1. It will therefore be understood that any impeller capable of directing molten bath metal downward and outward in the manner described herein could be used. In addition, impeller 300 could have more than three vanes or fewer than three vanes. Further, each of the vanes of impeller 300 could have different configurations as long as at least one vane has a portion that directs molten metal downward and at least one vane has a portion that directs molten metal outward from impeller 300.

In the preferred embodiment, projection. 302B is positioned farther from lower wall 2 than portion 302A. This is because the molten metal in bath B should first be directed downward towards lower wall 2 before being directed outward away from impeller 300 towards vessel wall 3. Projection 302B has a top surface 312 and a lower surface 314. Projection 302B further includes a leading edge 316 and an angled surface (or first surface) 318, which is preferably formed in surface 314 adjacent leading edge 316. As will be understood, surface 318 is angled (as used herein the term angled refers to either a substantially planar angled surface, or a curved surface wherein the angle can be measured from any point along the curved surface, or a multifaceted surface) such that, as impeller 300 turns (as shown it turns in a clockwise direction) surface 318 directs molten metal towards lower surface 2. Any surface or structure that functions to direct molten metal towards lower surface 2 may be used, but it is preferred that surface 318, which is formed at a 45° planar angle, be used.

Portion 302A, which is preferably vertical (but can be angled or curved), extends from the back (or trailing portion) of projection 302B. Portion 302A has a leading face (or second surface) 332 and a trailing face 334. Leading face 332 is preferably planar and vertical, although it can be of any configuration that directs molten metal outward away from impeller 300.

Projection 302B has a height H1 and a width W1. Portion 302A has a height H2 and a width W2. As shown, portion 302B traps gas as it rises, thus helping to improve the efficiency of device 10 when impeller 300 is used. A recess 350 is formed from top surface 312 to trailing face 334. Preferably, recess 350 begins at a position on surface 312 forward of face 332 and terminates at a position on face 334. The purpose of recess 350 is to allow more molten metal positioned within bath B above top surface 312 to move downward into contact with sections 302B and 302A, thus increasing the displacement of impeller 300.

Figure 7:
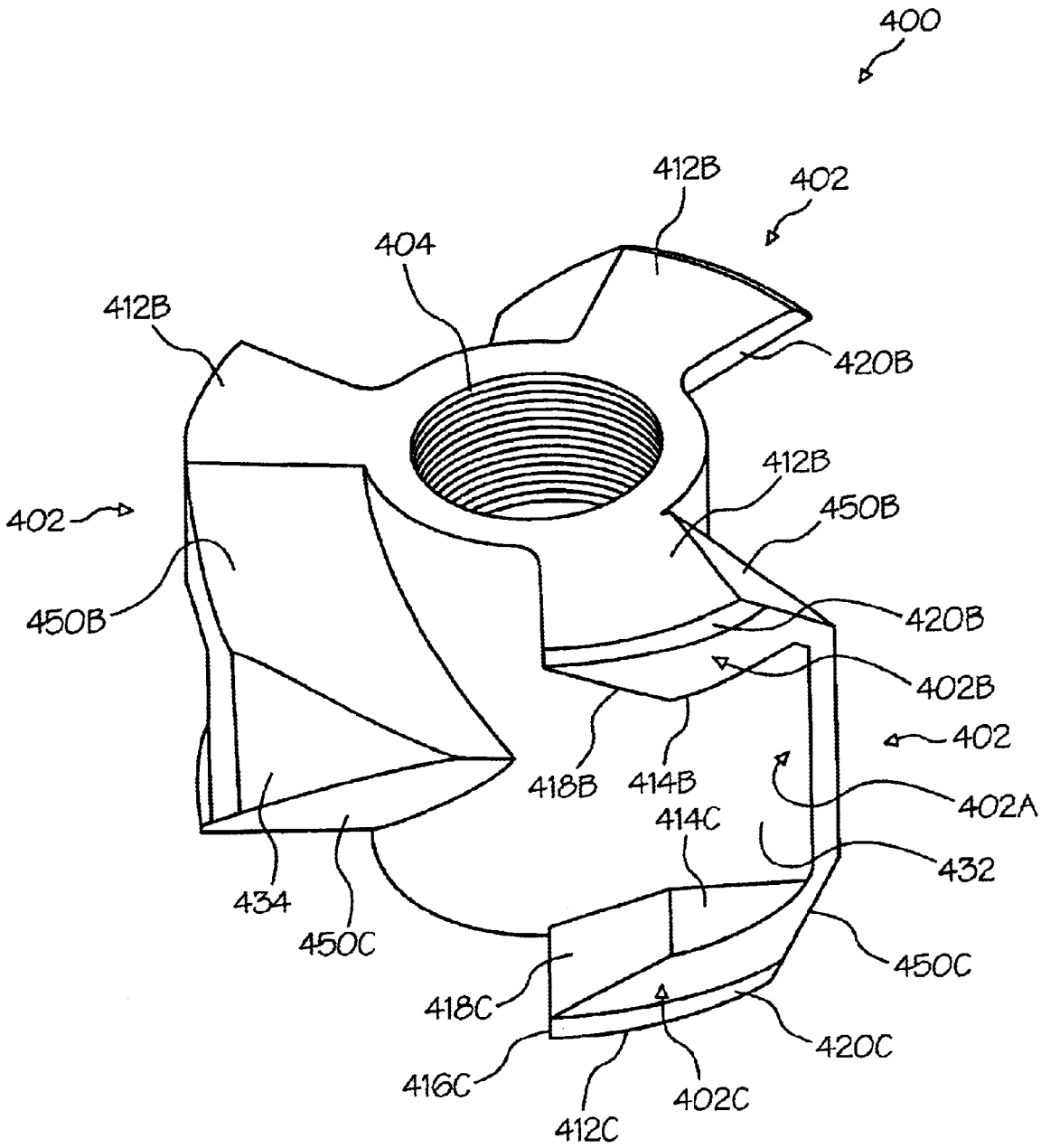
FIG. 7 is a perspective view of an alternate impeller according to the invention.

Another alternate, tri-flow impeller 400 is shown in FIG. 7. Impeller 400 is preferably imperforate, formed of solid graphite and connected to and driven by shaft 100. Impeller 400 preferably has three vanes 402, but may have fewer than three vanes or more than three vanes. Impeller 400 further includes a connective portion 404 which is preferably a threaded bore, but can be any structure capable of drivingly engaging shaft 100.

Impeller 400 rotates about an axis Y. Preferably, each vane 402 includes (1) a first portion for directing molten metal outward away from rotor 400 (which is preferable vertically-oriented portion 402A, (2) a second portion positioned relative a side of the first portion, the second portion for directing molten metal towards the first portion (the second portion is preferably upper horizontally-extending projection 402B), and (3) a third portion positioned relative the first portion such that it is on a side opposite the second portion, the third portion for directing molten metal towards the first portion (the third portion is preferably lower horizontally-extending projection 402C).

Preferably each vane 402 has the same configuration so only one vane 402 shall be described. Each vane, may, however have a different configuration as long as at least one vane has at least a first portion, at least one vane has at least a second portion, and at least one vane has a third portion. Upper horizontally-extending projection 402B is preferably positioned farther from vessel lower surface 2 than portion 402A. The purpose of projection 402B is to direct molten metal downward towards lower surface 2, and any structure or shape that accomplishes this purpose may be used. Projection 402B is so positioned because the molten metal in bath B should first be directed downward towards lower surface 2 before being directed outwards from impeller 400 and towards vessel wall 3. Projection 402B has a top surface 412B and a lower surface 414B. Projection 402B also includes a leading edge 416B and an angled surface (or first surface) 418B, which is preferably formed in surface 414B adjacent leading edge 416B. Surface 418B is angled (as used herein the term angled refers to either a substantially planar surface, or a curved surface in which the angle can be measured at any point along the curved surface, or a multi-faceted surface) such that, as impeller 400 turns (as shown in turns in the clockwise direction) surface 418B directs molten metal towards lower 2. It is preferred that surface 418B be formed at a 45° planar angle.

Lower horizontally-extending projection 402C is preferably positioned closer to vessel lower 2 than portion 402A. The purpose of projection 402C is to direct molten metal upward towards portion 402A, and any structure or shape that accomplishes this purpose may be used. Projection 402C has a lower surface 412C and a top surface 414C. Projection 402C also includes a leading edge 416C and an angled surface (or third surface) 418C, which is preferably formed in surface 414C adjacent leading edge 416C. Surface 418C is angled (as used herein the term angled refers to either a substantially planar surface, or a curved surface wherein the angle is measured from any point on the curved surface, or a multi-faceted surface) such that, as impeller 400 turns (as shown it turns in the clockwise direction) surface 418C directs molten metal away from lower 2 towards portion 402A. It is preferred that surface 418C be formed at a 45° angle.

Having now described preferred embodiments of the invention, modifications that do not depart from the spirit of the invention may occur those skilled in the art. The present invention is thus not limited to the preferred embodiments but is instead set forth in the following claims and legal equivalents thereof.

What is claimed is:

1. A device for releasing gas into molten metal, the device comprising:

(a) an impeller having a top surface, a bottom surface, three or more sides, and at least one cavity in each of the sides open to the bottom surface;

(b) a shaft having a first end, a second end and a passage for transferring gas, the second end connected to the impeller;

(c) a drive source connected to the first end of the shaft, the drive source for rotating the shaft and the impeller; and (d) one or more gas-release openings positioned in or beneath the bottom surface;

whereby a gas source is supplied to the passage of the shaft, and the drive source is operated to rotate the shaft and impeller and the gas passes through the passage and is released through the one or more gas-release openings and at least some of the gas enters the cavities, where it is mixed with molten metal and the molten metal/gas mixture is displaced by the impeller.

2. The device of claim 1 wherein the impeller is rectangular in plan view and has four sides and four corners.

3. The device of claim 2 wherein the impeller has one gas-release opening.

4. The device of claim 3 wherein the one gas-release opening is in the center of the bottom surface of the impeller.

5. The device of claim 2 wherein the impeller has four cavities, a respective cavity being formed in each of the sides.

6. The device of claim 2 wherein the impeller has four cavities, a respective cavity being formed in each of the corners.

7. The device of claim 5 wherein each respective cavity is centered on one of the respective four sides.

8. The device of claim 5 wherein the impeller is square.

9. The device of claim 5 wherein each of the sides has a length and each cavity has a length, the length of at least one cavity being more than ½ the length of the side on which it is formed.

10. The device of claim 2 wherein the impeller has three cavities, each cavity being formed in one of the respective four corners.

11. The device of claim 1 wherein each cavity has the same configuration.

12. The device of claim 1 wherein the shaft is comprised of (a) a drive shaft having a first end and a second end, and (b) an impeller shaft having a first end and a second end, the first end of the drive shaft being connected to the drive source the second end of the drive shaft being connected to the first end of the impeller shaft.

13. The device of claim 12 that further includes a coupling for connecting the drive shaft to the impeller shaft, the coupling having a first portion connected to the second end of the drive shaft and a second portion connected to the first end of the impeller shaft.

14. The device of claim 1 wherein the one or more gas-release openings are formed in the bottom surface of the impeller.

15. The device of claim 1 that further includes one or more cavities in the upper surface.

16. A device for releasing gas into molten metal contained within a vessel having a vessel wall and a vessel bottom, said device comprising:

(a) a drive source;

(b) a shaft having a first end, a second end and a passage for transferring gas, the first end connected to the drive source; and (c) a dual-flow impeller including a bottom surface and a plurality of vanes, wherein each of the vanes includes:

(i) a first surface for moving molten metal downward towards the vessel bottom, the first surface being formed at an angle other than vertical;

(ii) a second surface for moving molten metal outwards away from the impeller, the second surface being positioned closer to the vessel bottom than the first surface; and (d) one or more gas-release openings.

17. The device of claim 16 wherein the vane has a vertical portion beneath the horizontally-extending projection and the second surface is the leading face of the vertical portion.

18. The device of claim 17 wherein the vertical portion has a width and includes a trailing face, a recess being formed on the vane, the recess extending from the upper surface of the projection to the trailing face of the vertical portion.

19. The device of claim 18 wherein the recess begins on the upper surface at a position forward of the second surface.

20. The device of claim 16 wherein the second surface is vertical.

21. The device of claim 16 wherein the impeller has a bottom surface and the opening is in the bottom surface.

22. The device of claim 16 wherein the one or more gas-release openings are formed in the bottom surface of the impeller.

23. The device of claim 16 wherein the impeller is imperforate.

24. An impeller for use in a device that mixes gas with molten metal, the impeller being square in plan view, having four sides, a top surface, a bottom surface, and comprising:

(a) one or more gas-release openings for releasing gas into a molten metal bath; and (b) cavity means for mixing gas with the molten metal.

25. The impeller of claim 24 wherein the cavity means is four cavities and each of the cavities is open to the bottom surface.

26. The impeller of claim 24 wherein the cavity means is one or more cavities in the bottom surface and one or more cavities is in the top surface.

27. A device for releasing gas into molten metal contained in a vessel, the vessel having a bottom, the device comprising:

(a) a shaft having a first end, a second end and a passage therein for the transfer of gas;

(b) a tri-flow impeller comprising:

(i) a connective portion connected to the second end of the shaft;

(ii) a plurality of vanes wherein:

(1) at least one vane includes a first surface for moving molten metal downward towards the vessel bottom, the first surface being formed at an angle other than vertical;

(2) at least one vane includes a second surface for moving molten metal outward away from the impeller; and (3) at least one vane includes a third surface for moving molten metal upward away from the vessel bottom, the third surface being formed at an angle other than vertical;

(c) one or more gas-release openings in communication with the passage; and (d) a drive source connected to the first end of the shaft, the drive source for rotating the shaft and the impeller.

28. The impeller of claim 27 wherein at least one of said vanes includes a first surface, a second surface and a third surface.

29. The impeller of claim 27 wherein there are three vanes, each of the vanes having a first surface, a second surface and a third surface.

30. The impeller of claim 25 wherein each side of the impeller includes a respective one of the four cavities.

31. The impeller of claim 30 wherein each cavity is centered on the side on which it is included.

32. The impeller of claim 25 wherein each of the cavities has the same configuration.

33. The impeller of claim 24 wherein the cavity means is three cavities.

34. The impeller of claim 33 wherein each of the cavities has the same configuration.

35. The device of claim 1 wherein the second end of the shaft is connected to the impeller using a connector having a threaded connection.

36. The device of claim 35 wherein the connector comprises a tapered threaded portion of the second end of the shaft and a corresponding tapered bore portion in the impeller.

37. The device of claim 16 wherein the shaft is connected to the dual-flow impeller with a threaded connector.

38. The device of claim 37 wherein the threaded connector comprises a tapered threaded portion on the second end of the shaft and a corresponding threaded bore on the dual-flow impeller.

39. The device of claim 27 wherein the second end of the shaft includes a tapered threaded portion and wherein the connective portion of the tri-flow impeller comprises a correspondingly threaded tapered bore.

* * * * *